US006966408B2

(12) United States Patent
Sweet

(10) Patent No.: US 6,966,408 B2
(45) Date of Patent: Nov. 22, 2005

(54) AUTOBALANCE ROPING AND DRIVE ARRANGEMENT

(75) Inventor: Robert H. Sweet, Lakeside, CA (US)

(73) Assignee: Thyssen Elevator Capital Corp., Whittier, CA (US)

( * ) Notice: Subject to any disclaimer, the term of this patent is extended or adjusted under 35 U.S.C. 154(b) by 184 days.

(21) Appl. No.: 10/282,635

(22) Filed: Oct. 29, 2002

(65) Prior Publication Data

US 2004/0079590 A1 Apr. 29, 2004

(51) Int. Cl.[7] ..... B66B 7/10
(52) U.S. Cl. ..... 187/264; 187/254; 187/266
(58) Field of Search ..... 187/254, 264, 187/265, 266, 282, 289, 411

(56) References Cited

U.S. PATENT DOCUMENTS

| | | | | |
|---|---|---|---|---|
| 657,380 A | * | 9/1900 | Baldwin et al. | 187/265 |
| 1,130,769 A | * | 3/1915 | Gale, Sr. | 69/34 |
| 1,566,385 A | * | 12/1925 | Dunn | 187/254 |
| 3,174,585 A | * | 3/1965 | Tofanellii | 187/264 |
| 3,845,842 A | | 11/1974 | Johnson | 187/15 |
| 5,241,141 A | * | 8/1993 | Cominelli | 187/295 |
| 5,437,347 A | * | 8/1995 | Biewald et al. | 187/264 |
| 5,469,937 A | | 11/1995 | Hakala et al. | 187/266 |
| 5,513,724 A | | 5/1996 | De Jong | 187/264 |
| 5,699,879 A | | 12/1997 | Sakita | 187/249 |
| 5,788,018 A | | 8/1998 | Mendelsohn et al. | 187/404 |
| 5,861,084 A | | 1/1999 | Barker et al. | 187/264 |
| 6,364,063 B1 | | 4/2002 | Aulanko et al. | 187/266 |
| 6,860,367 B1 | * | 3/2005 | Ericson | 187/265 |

FOREIGN PATENT DOCUMENTS

| | | |
|---|---|---|
| CA | 2170813 | 3/1996 |
| DE | 298 15 743 U1 | 12/1998 |

* cited by examiner

*Primary Examiner*—Eileen D. Lillis
*Assistant Examiner*—Thuy V. Tran
(74) *Attorney, Agent, or Firm*—Frost Brown Todd LLC

(57) ABSTRACT

An autobalancing roping and drive arrangement for elevators which continuously balances the weight of an elevator cab and the weight of a counterweight such that the force on the drive motor necessary to move the cab from floor to floor is minimized. A weighting device connected to a drive sheave imparts a downward force on the drive sheave and creates a tension in a force section, causing traction contact between the drive sheave and the drive rope. The tension in the force section includes a downward vertical component of force. This component and the weight of the counterweight combine to create a downward force on one side of the suspension sheave section. The downward force balances the downward force created by the weight of the cab on the opposite side of the suspension sheave section. The tension in the force section automatically compensates for the difference in weight between the cab and the counterweight and thereby maintains the elevator in balance.

7 Claims, 1 Drawing Sheet

AUTOBALANCE ROPING AND DRIVE ARRANGEMENT

FIELD OF THE INVENTION

The claimed invention is directed to the field of elevator technology. More specifically, the invention is directed to an autobalancing roping and drive arrangement for elevators which continuously balances the weight of an elevator cab and the weight of a counterweight such that the force necessary to move the cab from floor to floor is minimized.

BACKGROUND OF THE INVENTION

Traction elevator systems typically comprise an elevator cab, a counterweight, and one or more sheaves from which the cab and counterweight are suspended. The counterweight typically weighs about the same as the elevator cab when the cab is filled to about 40% capacity.

There are certain problems in attempting to balance the weight of an elevator cab with a counterweight. For example, the counterweight typically has a static, non-varying weight, whereas the cab will always have a variable load. Therefore, the cab and counterweight will not always be in balance. This condition presents stresses on the drive motor.

U.S. Pat. No. 3,845,842 discloses a traction elevator system wherein upper chambers within the car and the counterweight receive a weight medium which is transferred between the chambers, and thereby vary the weight of the car and the counterweight in relation to changes in the loaded weight of the car. The weight medium can be a fluid or chains. However, this system has drawbacks such as the potential for fluid leakage and loud noises produced by chain movement.

U.S. Pat. No. 5,788,018 attempts to overcome balancing issues by eliminating the counterweight and relying instead on a continuous hoist rope and comparatively heavy compensation sheave mounted at the lower end of the elevator shaft. The weight of the compensation sheave and its associated support assembly is carried by the drive rope, thereby applying traction force to the rope itself sufficient to hold the car and move it to a desired position. Nevertheless, the heavy compensation sheave still functions to counterweigh the cab.

There is therefore a need for an improved elevator system wherein the weight of the cab is effectively and continuously counterbalanced to minimize the load on a drive motor.

SUMMARY OF THE INVENTION

The claimed invention addresses these problems associated with prior art elevators. The claimed invention allows for adjustments to be made to an elevator system comprising a cab and counterweight such that the weight of the cab and the weight of the counterweight are continuously in a state of balance. The invention reduces the load on a drive motor in the elevator in that the motor is always driving a balanced cab and counterweight system. Because the cab and counterweight are continuously kept in a state of balance, there is less of an opportunity for motor overload and the horsepower requirements for the motor are lessened, thereby permitting the use of smaller or lighter motors.

The claimed invention comprises a vertically displaceable elevator cab and counterweight, a suspension sheave section, a drive sheave, and a weighting device. A suspension rope passing over and guided by the suspension sheave section connects the cab and counterweight on opposite sides of the suspension sheave section. A drive rope is connected to the bottom of the cab and counterweight, and is guided by a deflector sheave. The drive rope is driven by a drive sheave located below the cab and counterweight.

A weighing device connected to the drive sheave imparts a downward force on the drive sheave and creates a tension in a force section along the length of the drive rope between the drive sheave and counterweight. This tension causes traction contact between the drive sheave and the drive rope and is used to drive the drive rope and thereby displace the cab and counterweight.

The tension in the force section and the weight of the counterweight combine to create a downward force on one side of the suspension sheave section. This downward force balances the downward force created by the weight of the cab on the opposite side of the suspension sheave section. The tension in the force section automatically compensates for the difference in weight between the cab and the counterweight and thereby maintains the elevator in balance.

The weighing device can comprise various forms. For example, in one embodiment of the invention, the weighing device comprises a lever arm connected to the motor. The lever arm comprises means for generating a downward force on the lever arm to cause the lever arm to pivot downwards about a pivot point Examples of such means are a variable force or a weight which slides along the length of the lever arm.

The downward force generated by the weighting device can vary from zero lbs. to 5,000 lbs. or more, depending on the specifications of the particular elevator system.

A unique aspect of the claimed invention is the variable balancing and the location of the drive component. In the claimed arrangement, the suspension ropes are not used to drive the cab and counterweight, and therefore no traction is required for the elements of the suspension sheave section. The one or more sheave(s) in the suspension section are merely used to provide a pulley system for the cab and the counterweight. However, a brake for the system can optionally be placed within the suspension sheave section.

In order to maintain strict control of the elevator system, a tensioning device may be used to remove slack from the drive ropes.

The suspension sheave section may be composed of one or more suspension sheaves, the number of which will depend upon the particular elevator installation. The suspension sheave section may be mounted to the roof of the elevator shaft. Alternatively, the suspension sheave section may be mounted to an upper wall of the elevator hoistway. The elevator cab and counterweight are affixed to opposite ends of the suspension rope which are guided by the suspension sheave section.

The elevator may further comprise a deflector sheave which is located below the cab or counterweight. The deflector sheave will typically be aligned with the drive sheave and provide a path for movement of the drive rope.

The elevator may also include a load sensing device in the cab. The load sensing device determines the load status of the cab and transmits this status to the weighting device. The weighting device would then adjust the amount of downward force necessary in the force section to keep the elevator in a balanced state.

The elevator may further comprise a control device for determining the amount of force required to balance the downward force created by the weight of the cab.

The elevator may further comprise an optional braking device, which may be located at any particular point in the elevator system. The braking device may be located in the suspension sheave section to respond quickly to any unexpected downward movement of the cab. If a braking device is included in the elevator system, a traction component and a traction calculation are introduced.

The elevator may further comprise electronic logic or electronic circuitry to carry out mathematical or logical instructions in performing the functions of the invention or the elevator.

The suspension rope and drive rope may each be formed from a single strand, or a plurality of separate and distinct strands which are woven or bound together. They may also consist of several separate ropes operating in parallel.

In another embodiment of the invention, the elevator can comprise means for converting potential energy into electrical energy and thereby allowing regeneration of power into the line. Means for converting potential energy to electrical energy are known to those of skill in the art. In this embodiment, the elevator can be maintained in a slightly overbalanced state, and the regenerated energy can be returned to the system, for example, when the motor is acting as an induction generator, or through a special power electronic setup as in the case of inverter-driven systems with regenerative capabilities. In this embodiment, the weight of the empty elevator cab would be slightly heavier than the weight of the counterweight, and the fixed counterweight would create a downward force which is less than the weight of the empty cab. The variable downward force would then be calculated so that the elevator system is always slightly overbalanced in the direction of travel. The variable load can be adjusted during the elevator run so that the forces are rebalanced to assist in the deceleration phase. It is expected that only a small amount of energy would be regenerated since a large regeneration would require a large motor to decelerate the load.

DETAILED DESCRIPTION OF THE INVENTION

Figure 1:
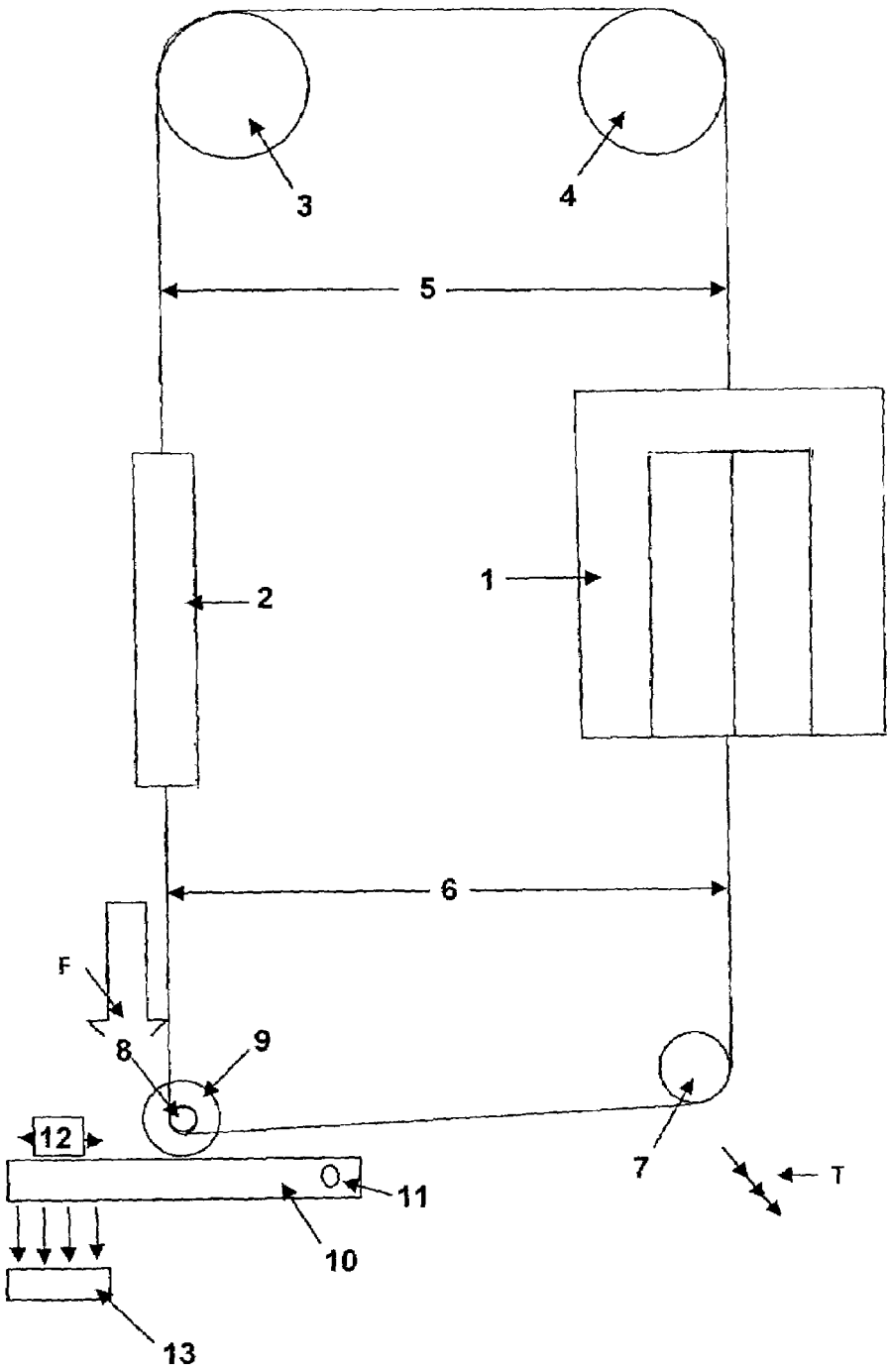
FIG. 1 shows an elevator system comprising a cab, a counterweight, and an autobalancing rope and drive arrangement in an embodiment of the invention.

An embodiment of the claimed invention will now be described with reference to FIG. 1. FIG. 1 shows elevator system comprising a cab 1 and a counterweight 2 located in a hoistway (not shown). The suspension sheave section is located at the top of the elevator hoistway and in this embodiment comprises two suspension sheaves 3 and 4. The top sides of cab 1 and the counterweight 2 are connected to opposite ends of a suspension rope 5, which is routed by the suspension sheaves 3 and 4. The suspension sheaves 3 and 4 guide the suspension rope 5, and do not have a traction drive component. The bottoms sides of the cab 1 and counterweight 2 are connected to opposite ends of a drive rope 6, which is routed by the deflector sheave 7 and drive sheave 8. The deflector sheave 7 and drive sheave 8 are located below the elevator cab 1 and counterweight 2. A motor 9 is connected to the drive sheave 8, which is used to move the cab 1 and the counterweight 2 in the hoistway.

In this embodiment of the invention, the weighting device comprises a lever arm 10. The drive motor 9 is mounted to the lever arm 10, which is allowed to pivot at pivot point 11. A downward force is provided by both weight 12 and variable force 13. The downward force causes tension in the drive rope 6 along force section F, which is that portion of the drive rope 6 extending from the bottom of the counterweight 2 to the drive sheave 8. Although the FIGURE shows the downward force is provided by both weight 12 and variable force 13, either the weight 12 or the variable force 13 alone can be used to provide the requisite downward force F in the force section.

A tensioning device, represented as T in the lower portion of the FIGURE, removes any slack from the drive ropes 6 in order to maintain strict control of the cab 1 within the hoistway. The empty cab will be balanced when the weight 12 is closest to the pivot point 11, or when the variable force 13 is zero. A cab transporting passengers or cargo will cause the weight 12 to move away from the pivot point 11, or the variable force 13 to be greater than zero.

Although two suspension sheaves 3 and 4 are shown in the FIGURE, more or fewer suspension sheaves may be appropriate or desirable in particular elevator installations. Likewise, a plurality of deflector sheaves 7 may be used to in certain embodiments of the invention.

Accordingly, numerous modifications and variations of the present invention are possible in light of the above teachings, and therefore the claimed invention may be practiced other than as explicitly described.

What is claimed is:

1. A traction drive elevator having an autobalancing roping and drive arrangement comprising:

a vertically displaceable elevator cab;

a vertically displaceable counterweight;

a suspension sheave section located above the cab and counterweight;

a suspension rope passing over and guided by the suspension sheave section, the suspension rope having a first end attached to the counterweight on one side of the suspension sheave section and having a second end attached to the cab on the opposite side of the suspension sheave section;

a drive sheave located below the cab and the counterweight;

a drive rope passing under and in traction contact with the drive sheave, the drive rope having a first end attached to the counterweight and having a second end attached to the cab, the length of drive rope between the drive sheave and counterweight defining a force section, the traction contact between the drive sheave and the drive rope for driving the drive rope and vertically displacing the cab and counterweight;

a weighting device connected to the drive sheave and imparting a force on the drive sheave and creating a tension in the force section that includes a downward vertical component of force;

wherein said weighting device comprises a lever arm which is moved downward by a variable force, the variable force causing the weight of the cab and the weight of the counterweight to be equalized such that the amount of force necessary to move the car between landings is minimized, said variable force being generated by a weight which slides along the length of the lever arm;

the downward vertical component of force in the force section and the weight of the counterweight combining to create a downward vertical force in the suspension rope on one side of the suspension sheave section to balance the downward force created by the weight of the cab on the opposite side of the sheave section.

2. The traction drive elevator according to claim 1, wherein the downward vertical component offeree generated by the tension in the force section varies from zero lbs to 5,000 lbs.

3. The traction drive elevator according to claim 1, further comprising a tensioning device for tensioning the drive rope and removing slack therefrom.

4. The traction drive elevator according to claim 1, wherein the suspension sheave section is composed of one or more suspension sheaves.

5. The traction drive elevator according to claim 1, further comprising a deflector sheave located below the cab.

6. The traction drive elevator according to claim 1, wherein the suspension rope, drive rope, or both, are comprised of a plurality of separate strands.

7. The traction drive elevator according to claim 1, wherein the drive sheave is driven by a regenerative drive motor capable of regenerating energy from the kinetic and potential energy created during operation of the elevator.

* * * * *

UNITED STATES PATENT AND TRADEMARK OFFICE

CERTIFICATE OF CORRECTION

PATENT NO. : 6,966,408 B2
DATED : November 22, 2005
INVENTOR(S) : Robert H. Sweet It is certified that error appears in the above-identified patent and that said Letters Patent is hereby corrected as shown below:

Column 5,
Line 2, "offeree" should read -- of force --.

Signed and Sealed this

Thirty-first Day of January, 2006

JON W. DUDAS
*Director of the United States Patent and Trademark Office*